US005090063A

United States Patent [19]

Edwards et al.

[11] Patent Number: 5,090,063

[45] Date of Patent: Feb. 25, 1992

[54] PACKAGED TOILET SEAT

[76] Inventors: Richard T. Edwards; Marilyn C. Edwards, both of 14512 Harbor Estate Rd., Charlotte, N.C. 28278

[21] Appl. No.: 615,239

[22] Filed: Nov. 19, 1990

[51] Int. Cl.[5] ..... A47K 13/14

[52] U.S. Cl. ..... 4/239; 4/242; 206/225; 206/233; 206/581

[58] Field of Search ..... 4/235, 239, 242, 237, 4/457, 460, 476, 483; 206/225, 233, 581, 823

[56] References Cited

U.S. PATENT DOCUMENTS

| | | | |
|---|---|---|---|
| 168,402 | 10/1875 | Laumonier | 4/239 |
| 496,536 | 5/1893 | Prins | 4/239 |
| 1,223,065 | 4/1917 | Meyer | 4/239 |
| 1,334,137 | 3/1920 | Delany | 4/239 |
| 2,443,068 | 6/1948 | Dahle | 4/239 |
| 2,537,504 | 1/1951 | Anderson | 4/239 |
| 2,742,650 | 4/1956 | Mohun et al. | 4/239 X |

FOREIGN PATENT DOCUMENTS

| | | | |
|---|---|---|---|
| 449763 | 8/1927 | Fed. Rep. of Germany | 4/239 |
| 484058 | 8/1953 | Italy | 4/239 |
| 619385 | 3/1949 | United Kingdom | 4/239 |

*Primary Examiner*—Ernest G. Cusick
*Assistant Examiner*—Robert M. Fetsuga
*Attorney, Agent, or Firm*—Clifton Ted. Hunt

[57] ABSTRACT

A portable toilet seat for use in public rest rooms is foldable for compact storage in a carrier equipped with a holder for a roll of toilet paper and a pocket for items of personal hygiene. The carrier may remain open and hung from the door of a rest room stall to make the remaining contents of the carrier easily accessible to the user after the seat is removed and unfolded for use.

5 Claims, 3 Drawing Sheets

PACKAGED TOILET SEAT

FIELD OF THE INVENTION

This invention relates to an auxiliary toilet seat for use on top of regularly installed toilet seats in public rest rooms and to a utilitarian package for transporting a portable toilet seat from place to place and for use in combination with the portable toilet seat at each place of use.

BACKGROUND OF THE INVENTION

The difficulty of finding clean and sanitary rest rooms, with all of the provisions intact, is well known to all highway travelers. Even when a facility is well cared for, there is an uneasy feeling about using a public toilet.

The desirability of placing an auxiliary toilet seat on top of a regularly installed toilet seat for sanitary reasons has long been recognized. See, for example, U.S. Pat. No. 396,803 issued Jan. 29, 1889 to Engelbert Breher for WATER CLOSET SEAT PROTECTOR.

Several patents have issued in the last 100 years for different constructions of auxiliary toilet seats. The following patents are exemplary of those that show auxiliary or portable toilet seats that are folded to occupy less space while being transported between uses:

| PATENT NO. | ISSUE DATE | INVENTOR | TITLE |
|---|---|---|---|
| 496,536 | May 2, 1893 | Prins | PRESERVATIVE COVER FOR WATER CLOSETS |
| 847,678 | Mar 19, 1907 | Michael | CLOSET SEAT |
| 1,405,370 | Jan 31, 1922 | Weaver | PORTABLE SUPPLEMENTAL TOILET SEAT |
| 2,537,504 | Jan 9, 1951 | Anderson | COMBINATION CHILD'S TOILET SEAT AND CARRYING BAG |
| 3,153,248 | Oct 20, 1964 | Miller | TOILET SEAT |
| 3,261,030 | July 19, 1966 | Blem | PORTABLE SEAT |

Prins, Michael, and Weaver show hinges at the front and back of the seat so it may be folded longitudinally when not in use. Both Prins and Weaver hinge their seats in such a way that the width of the folded halves of the seat is the same as half the width of an unfolded seat.

Michael provides transverse slides at the hinge points of his toilet seat so that the two halves of the unfolded seat may be pulled apart transversely to widen the seat for adult use, or left together for use by a child. One desirable feature of the folded seat of Michael is that it occupies less space and enables more compact packaging than the folded seats of Prins and Weaver. The compactness of the Michael seat is obtained by the structure of the present invention without the expense and labor intensity of providing the transverse slides.

Anderson and Miller show bags or packages for carrying portable toilet seats when not in use. Anderson's toilet seat is described as a child's seat which is folded and shaped to serve as the handle of a bag for a child's diapers or clothing. The child's seat is, of course, smaller than an adult's toilet seat. Accordingly, Anderson was not concerned with the problem of folding the seat in such a way as to provide a compact package.

Miller's package for his inflatable toilet seat is simply an envelope to hold the deflated seat and nothing more.

Blem provides hinges at all four quadrants of the portable seat. A pair of hinges are provided to define a short segment of the seat at its rear. The short segment of seat functions as an interconnecting link between the rearward segments of the seat to accomplish folding of the seat in compact quarters.

SUMMARY OF THE INVENTION

The packaged seat of this invention allows a person to use a public facility in confidence that there will be no physical contact with the regularly installed toilet, and that all needed provisions are within reach.

It is an object of the invention to provide a portable toilet seat which is foldable into a compact package within a carrying case resembling a conventional traveling bag.

It is a more specific object of this invention to provide a foldable toilet seat with a pair of hinges at each end defining short segments of the seat between each pair of hinges. The short segments of the seat serve two functions: they contribute to the compactness of the folded seat by reducing the height of the folded unit, and they provide space when the seat is folded for spacer tabs fastened to the bottom of the seat.

It is a further object of the invention to provide a carrier that functions as an accessory when the seat is unfolded and put to its intended use. The carrier contains a mounted roll of toilet paper and a pocket for items of personal hygiene, and includes a strap for hanging the opened carrier on the door of a rest room stall for easy access to its contents.

DETAILED DESCRIPTION OF THE INVENTION

Figure 1:
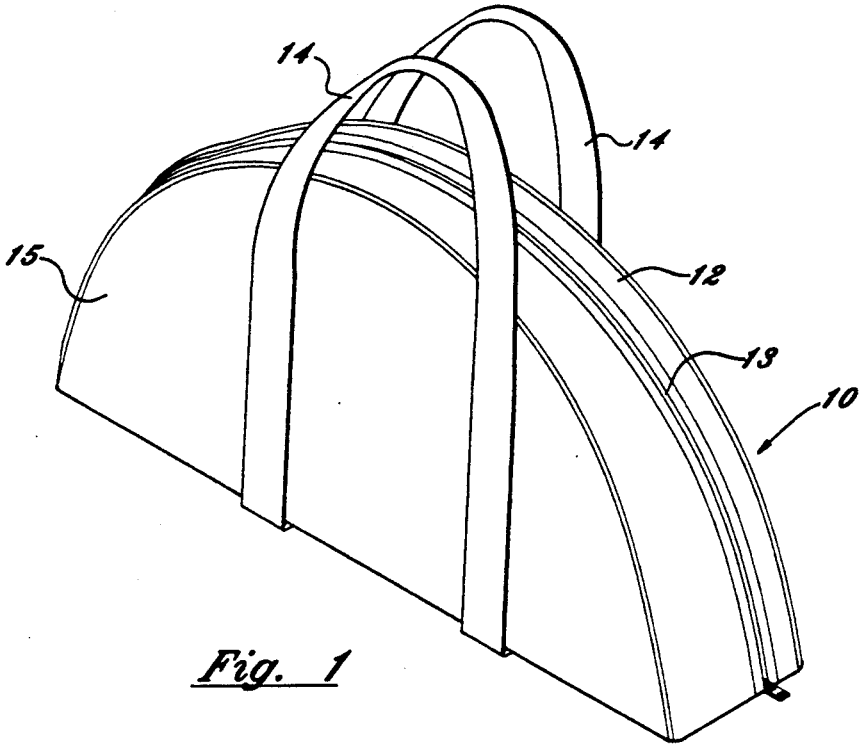
FIG. 1 is a perspective view of the carrier for the packaged toilet seat, closed for travel.

Referring more specifically to the drawings, the packaged toilet seat includes an openable carrier enclosure, broadly indicated at 10, (generally referred to herein as a carrier) and a foldable toilet seat, broadly indicated at 11.

The carrier 10 is shaped to resemble a conventional traveling bag with a rounded top 12, a zipper 13 extending across the top, and strap handles 14 rising from the sides 15 and 16 of the carrier. The carrier may be made of any suitable flexible material, such as nylon. A pocket 17 is provided on the inner surface of the flexible side 15 to carry items of personal hygiene.

A base 20 of generally rectangular configuration is fixed inside the bottom of the carrier 10. The base is rigid and may be formed of wood or a suitable plastic. The end portions 21 and 22 of the base 20 are preferably tapered inwardly as at 23.

Figure 7:
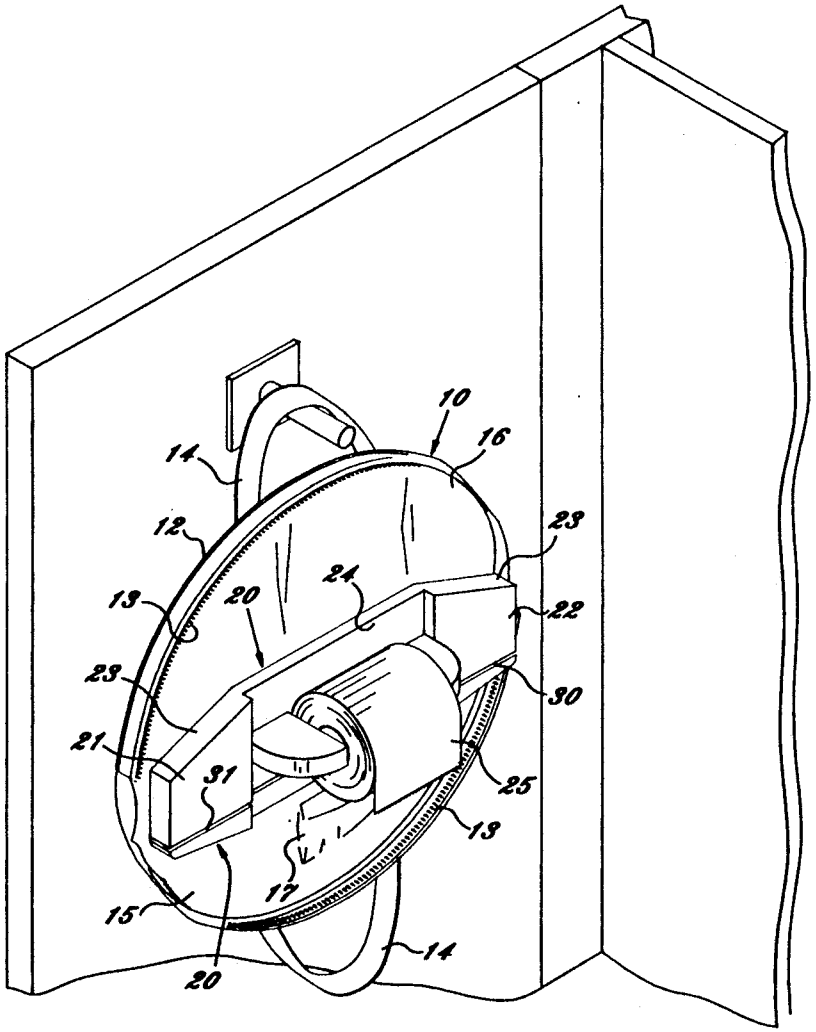
FIG. 7 is a perspective view of the opened carrier hanging on the door of a stall in a public rest room with its supply of toilet paper and the contents of its pocket easily accessible while the toilet seat is in use.
Figure 5:
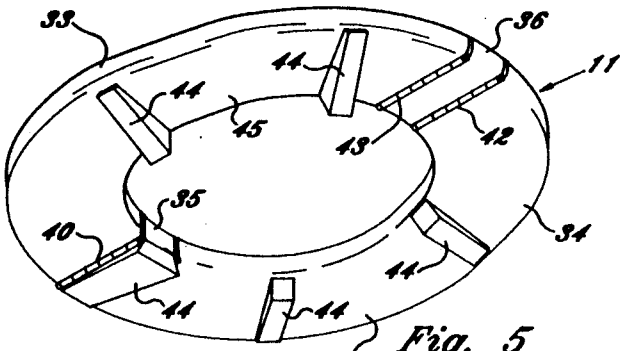
FIG. 5 is a perspective view looking at the bottom of the extended toilet seat shown in FIG. 4.
Figure 6:
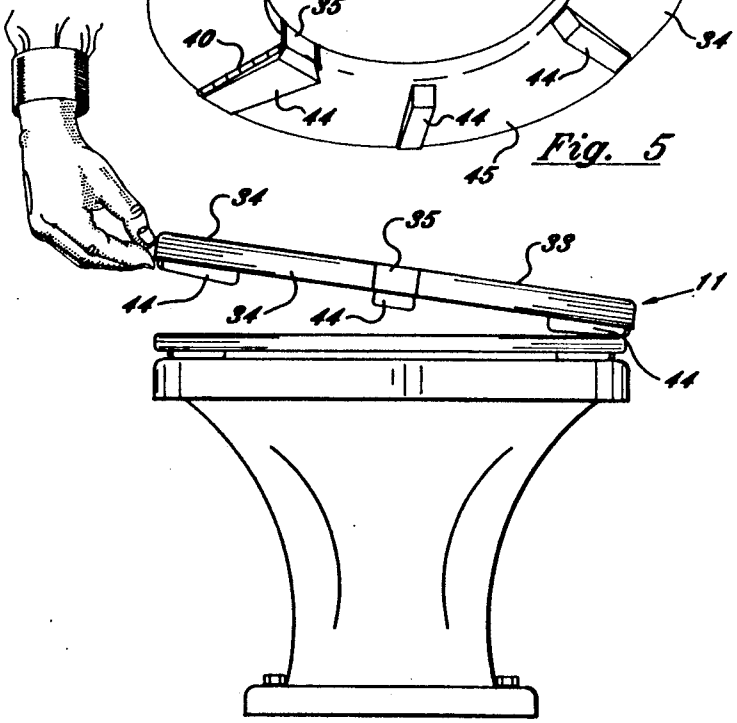
FIG. 6 is a front view of a toilet, illustrating the removal of the foldable toilet seat from the top of a regularly installed toilet seat.

The central portion 24 of the base is recessed from the common plane of the end portions 21 and 22 to accomodate a roll of toilet paper 25 supported on a roller 26 mounted on stanchions 27 rising from the central portion 24 of the base. The base is split longitudinally as at 30 beneath the stanchions 27 in FIG. 7 to define a narrow section $20^1$ of the base, which is hinged as at 31 to the main portion 20 of the base. The weight of the hinged narrow section $20^1$ of the base tends to cause it and the side 15 of the carrier, to which the narrow section $20^1$ is attached, to hang vertically when the opened carrier is hung on a door, as in FIG. 7.

Figure 4:
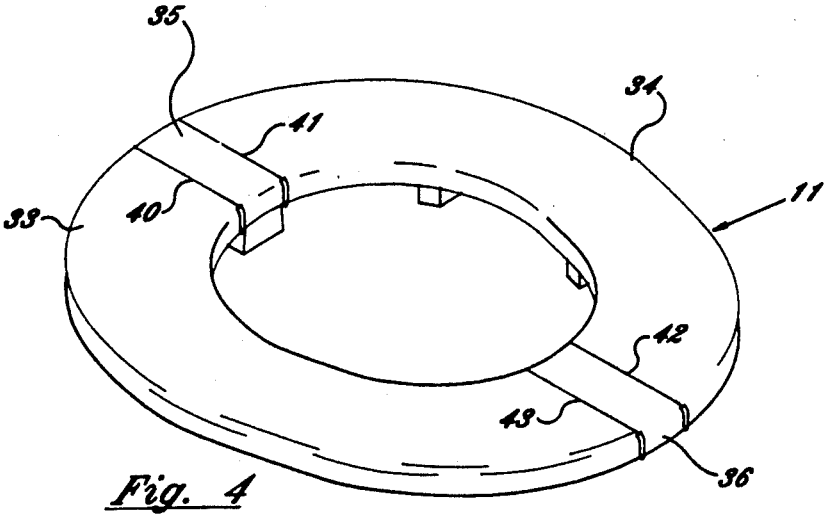
FIG. 4 is a perspective view looking at the top of the toilet seat in unfolded or extended position, ready for use.

The portable toilet seat 11 may be made of any desired material such as wood or plastic and is of a conventional shape when unfolded as in FIG. 4. The seat 11 comprises curved side segments 33 and 34 and short relatively straight front and rear segments 35 and 36. The segments of the seat are defined by hinges 40, 41, 42, and 43. Spacer tabs 44 are fastened to and extend outwardly from the bottom surface 45 of the seat 11.

In use, the spacer tabs 44 rest on the top of a conventional regularly installed toilet seat, and serve to space the seat 11 a comfortable distance from the regularly installed toilet seat.

Figure 2:
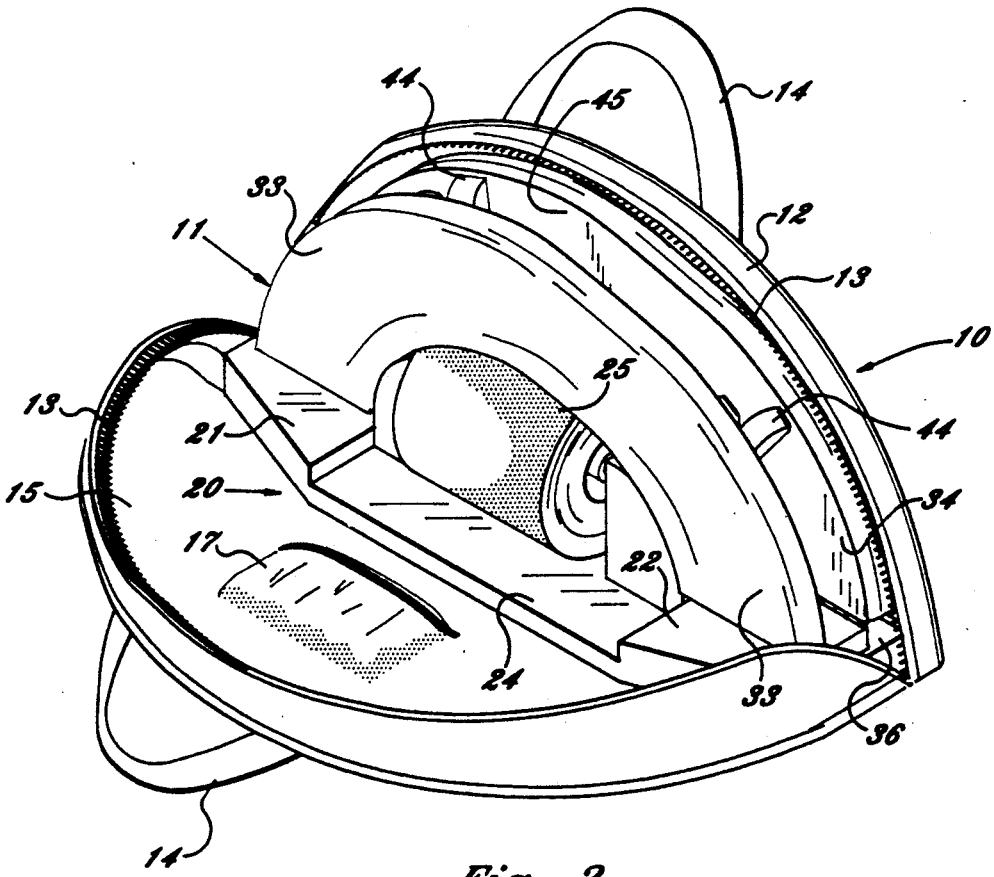
FIG. 2 is a perspective view illustrating the folded toilet seat and a roll of toilet paper within the partially opened carrier of FIG. 1.
Figure 3:
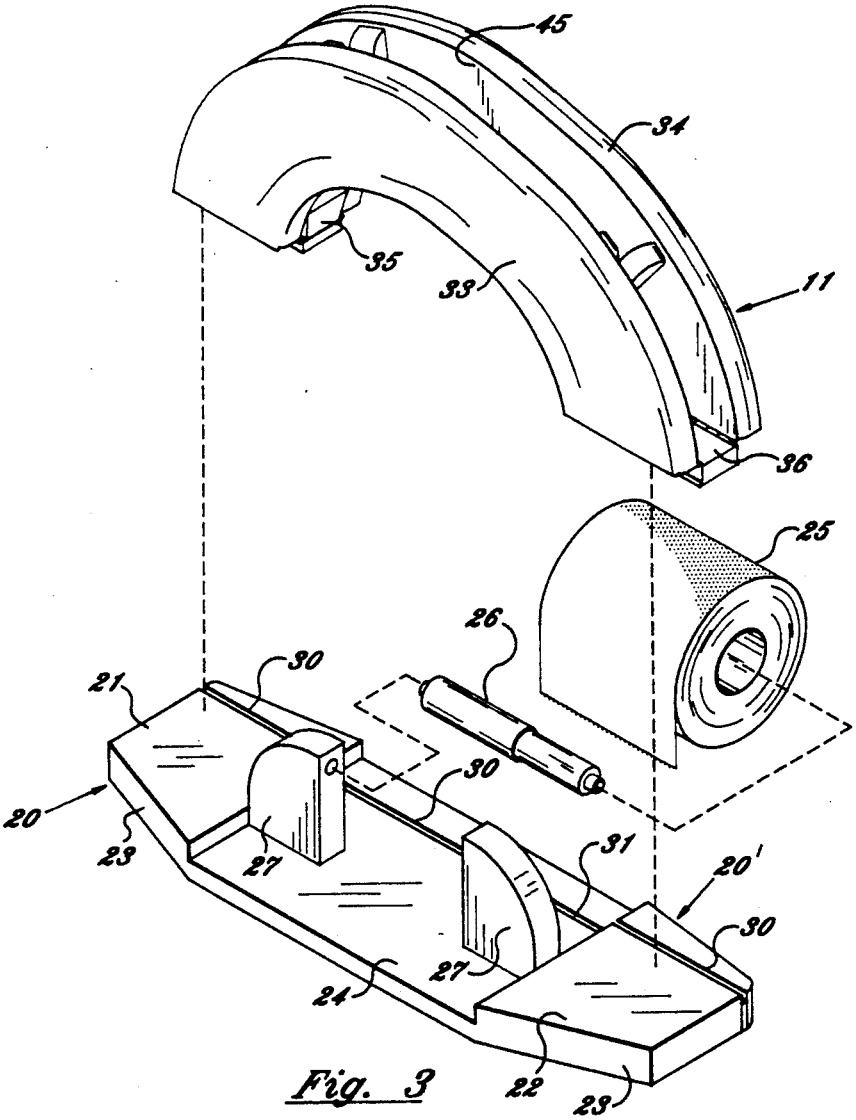
FIG. 3 is an exploded perspective view illustrating the assembly of the folded toilet seat and the roll of toilet paper within the carrier shown in FIG. 1, but omitting the carrier.

Referring to FIGS. 2 and 3, the seat 11 is folded for storage within the carrier 10 by folding the curved side segments 33 and 34 into juxtaposition with their bottoms 45 facing each other but spaced apart a distance equal to the individual length of the short segments 35 and 36. The spacing of the segments 33 and 34 from each other accomodates the spacer tabs 44, and correspondingly shortens the height of the folded seat.

The short segments 35 and 36 rest on the end portions 21 and 22 of the base 20 within the carrier 10 and provide a stabilized support for the folded seat, which partially encircles the roll of paper 25 within the carrier (FIG. 2).

There is thus provided a packaged toilet seat that is constructed to fold into a compact and practical configuration within a companion carrier for storage and traveling, and wherein the carrier is constructed to contain and present toilet accessories for ready access while the seat is in use.

Although specific terms have been employed in describing the invention, they have been used in a generic and descriptive sense only and not for the purpose of limitation.

We claim:

1. A packaged toilet seat including a an openable carrier enclosure, a rigid elongated base secured within the carrier, the rigid base including end portions and a center portion, means for supporting a roll of toilet paper on the center portion of the rigid base, a foldable toilet seat, and hinge means for allowing the toilet seat to be folded in half with the halves being in juxtaposition with each other, said hinge means including means for supporting the toilet seat in folded condition on the end portions of the rigid base and in partially encircling relation to the means for supporting a roll of toilet paper.

2. A packaged toilet seat according to claim 1 wherein the carrier is made of flexible material and includes a strap for hanging the opened carrier for access to the contents of the carrier while the seat is removed and in use.

3. A packaged toilet seat according to claim 2 wherein the rigid base is split longitudinally and hinged to be positioned vertically while the carrier is hanging.

4. A packaged toilet seat according to claim 1 wherein the carrier includes a pocket on its inner surface.

5. A packaged toilet seat according to claim 1 wherein the means for supporting the foldable toilet seat includes short segments which rest on the base when the seat is folded for storage in the carrier.

* * * * *